US006905169B1

(12) United States Patent
Donoghue

(10) Patent No.: US 6,905,169 B1
(45) Date of Patent: Jun. 14, 2005

(54) TRIANGULAR CHILD'S BOOSTER SEAT

(76) Inventor: Robert J. Donoghue, 2016 S. Federal Hwy. #E-109, Boynton Beach, FL (US) 33435

( * ) Notice: Subject to any disclaimer, the term of this patent is extended or adjusted under 35 U.S.C. 154(b) by 0 days.

(21) Appl. No.: 10/746,227

(22) Filed: Dec. 24, 2003

(51) Int. Cl.[7] ..... A47C 1/08
(52) U.S. Cl. ..... 297/250.1; 297/219.12; 297/228.12; 5/653
(58) Field of Search ..... 297/250.1, 219.12, 297/228.12, 228.13, 195.11, DIG. 1; 5/653, 5/655.9, DIG. 953; 224/681, 677, 679, 676, 224/660, 580, 584; 2/69.5, 338

(56) References Cited

U.S. PATENT DOCUMENTS 1,776,983 A * 9/1930 Rotherham ..... 383/4
2,988,760 A * 6/1961 Sarbach ..... 297/452.6
4,545,414 A * 10/1985 Baum ..... 224/580
4,836,605 A * 6/1989 Greenwood et al. ..... 297/250.1
5,209,385 A * 5/1993 Ledesma ..... 224/681
D356,705 S * 3/1995 Aston ..... D6/502
5,475,886 A * 12/1995 Mintz ..... 5/653
D379,282 S * 5/1997 Hueneke ..... D6/601
D394,336 S * 5/1998 Gillikin, Sr. ..... D2/642

* cited by examiner

*Primary Examiner*—Peter M. Cuomo
*Assistant Examiner*—Stephen Vu
(74) *Attorney, Agent, or Firm*—McCormick, Paulding & Huber LLP

(57) ABSTRACT

A polyfoam cushion is formed as a triangular right prism 12 inches on a side and 5 inches in height. A thin cover encloses the prism, and defines a zippered pocket in which string fasteners are provided for securing the assembly to a chair. Safety straps encircle the child, and these straps are also stowed in the pocket. The polyfoam is relatively stiff, in order to support a 50 pound child without compressing the polyfoam prism. The use of polyfoam yields a cushion of less than one pound in weight, the child can transport his cushion by holding a handle located on the same side as the pocket.

5 Claims, 5 Drawing Sheets

TRIANGULAR CHILD'S BOOSTER SEAT

BACKGROUND

This invention relates generally to booster seats for children, and deals more particularly with a padded triangular shaped prism 12 having parallel top and bottom surfaces, the top surface being padded, and the corners being rounded. The flat top portion is designed specifically to allow children to sit comfortably atop a chair. On the top surface of the booster chair, a design of the child's favorite toy such as teddy bears, Poky Elmos or Barneys can be applied. Three generally flat equilateral sides 12*a*, 12*b* and 12*c* complement the contoured side edges, and the convex corners of the prism provide a compact seat readily transported by handle 100.

SUMMARY OF INVENTION

One of the three sides defines a rear portion which has a pocket with a zippered closure 19. Ties 15, 15 or other flexible fasteners are secured to the inside of the pocket 20. A seat belt 18*a*, 18*b* is also secured to the one side, or to the inside of the pocket 20, for securing the child to the seat. The ties or flexible fasteners 15, 15 are preferably stored in the pocket 20 when not in use, and can be readily deployed for use in securing the booster seat to a chair. A seat belt 18*a*, 18*b* can also be provided. When the seat is in use the pocket 20 can still be used as a storage place for a child's belongings. The pocket 20 is large enough to hold a pacifier, crayons, small pads of paper or other miscellaneous items (not shown). The seat is ideal for use in a restaurant setting, with its easy set up and removal features. Many children cry when being placed in a confined high chair, this seat serves the purpose of a high chair but allows the young child to freely move around. The booster seat 10 can be used at the movies, at home, at the grandparents' house, and at restaurants. In restaurants the child can sit between Mom & Dad instead of being confined to a high chair. The five-inch height of the polyfoam cushion 12 puts the child at the same height as an adult.

DETAILED DESCRIPTION

Figure 1:
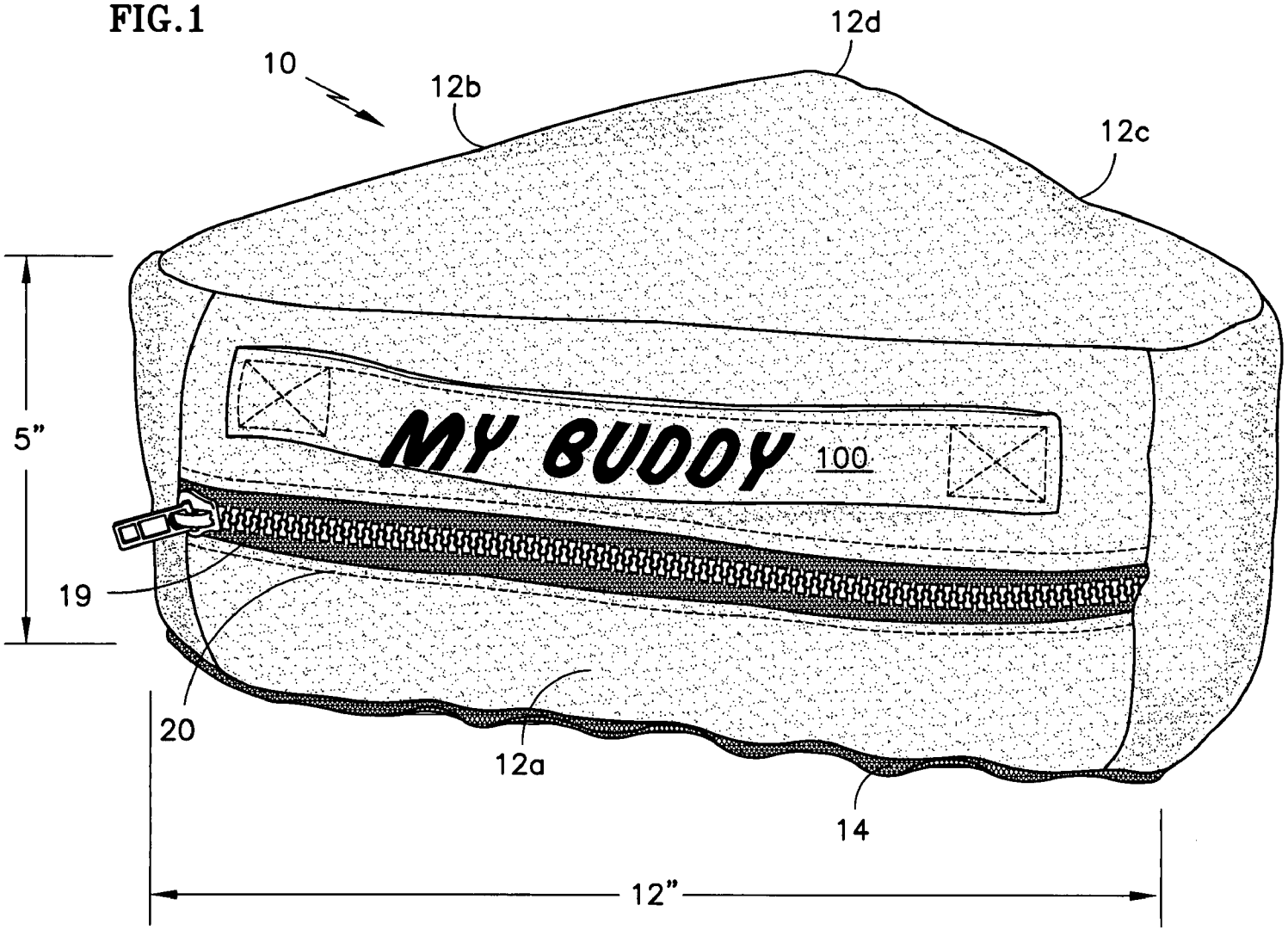
FIG. 1 is a top rear perspective view of the booster seat, with the cylindrically contoured corner edges. This view also shows a strap handle 100 for use in carrying the booster seat, the pocket 20 for storage and the cover zipper 14.
Figure 2:
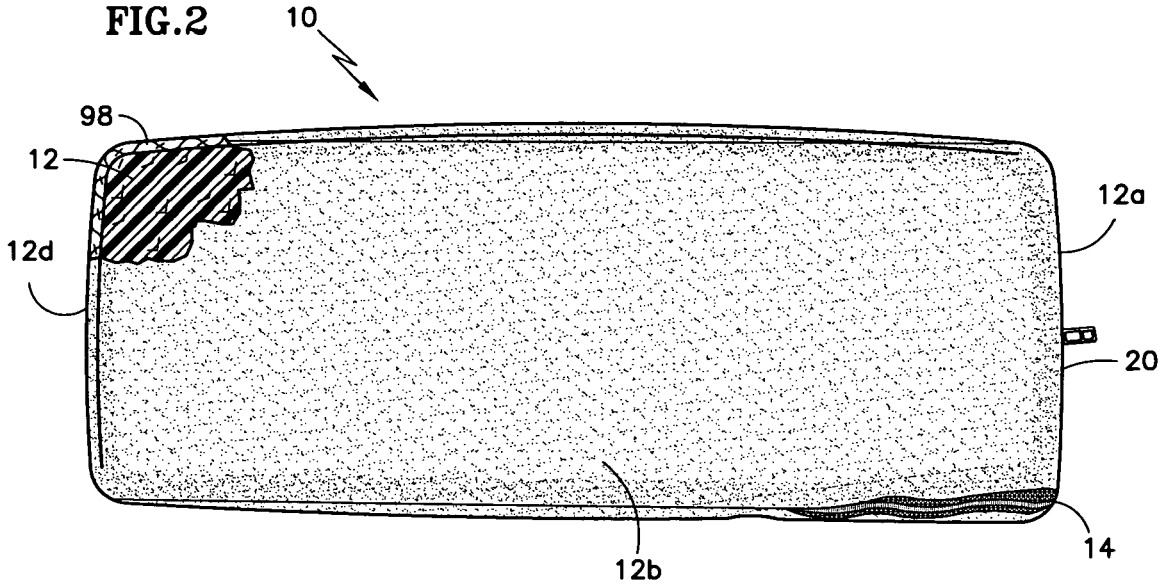
FIG. 2 shows the seat 10 in a side elevation view.
Figure 3:
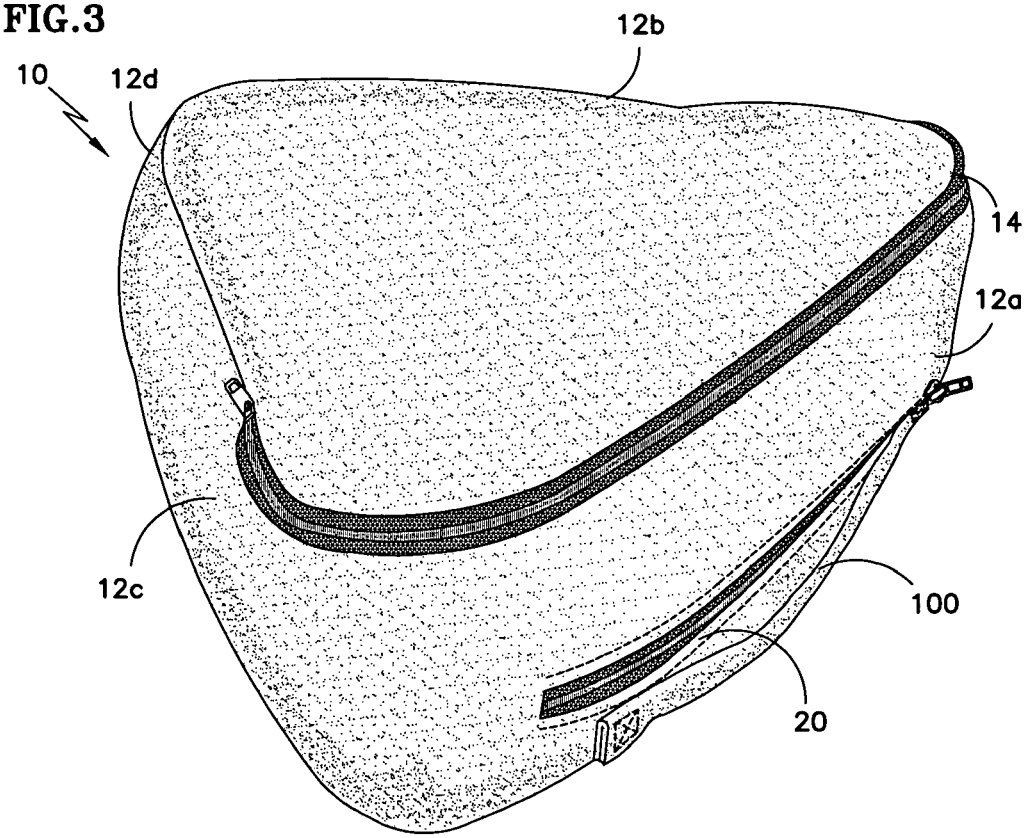
FIG. 3 is a bottom perspective view of the booster seat showing the zipper 19 for pocket 20, and the cover zipper 14 to provide access to the foam cushion 12. This view also shows the strap handle 100 for carrying the booster seat.

The presently preferred construction for a child's booster seat 10 calls for cutting or molding a foam cushion 12, preferably polyfoam, from a sheet of approximately 5 inches in thickness, to provide a triangular shape. Then, fitting such cushion into an envelope 98 fabricated by conventional means to have the desired shape for covering the cushion. The cover 98 can be either stitched in place, and provided with a zipper 14 along the bottom horizontal edge as suggested in FIG. 3 for example. The polyfoam cushion 12 can be removed by unzipping the zipper and withdrawing the cushion 12. Once the polyfoam cushion is removed, the booster seat fabric cover 98 can be washed or dry cleaned.

Figure 4:
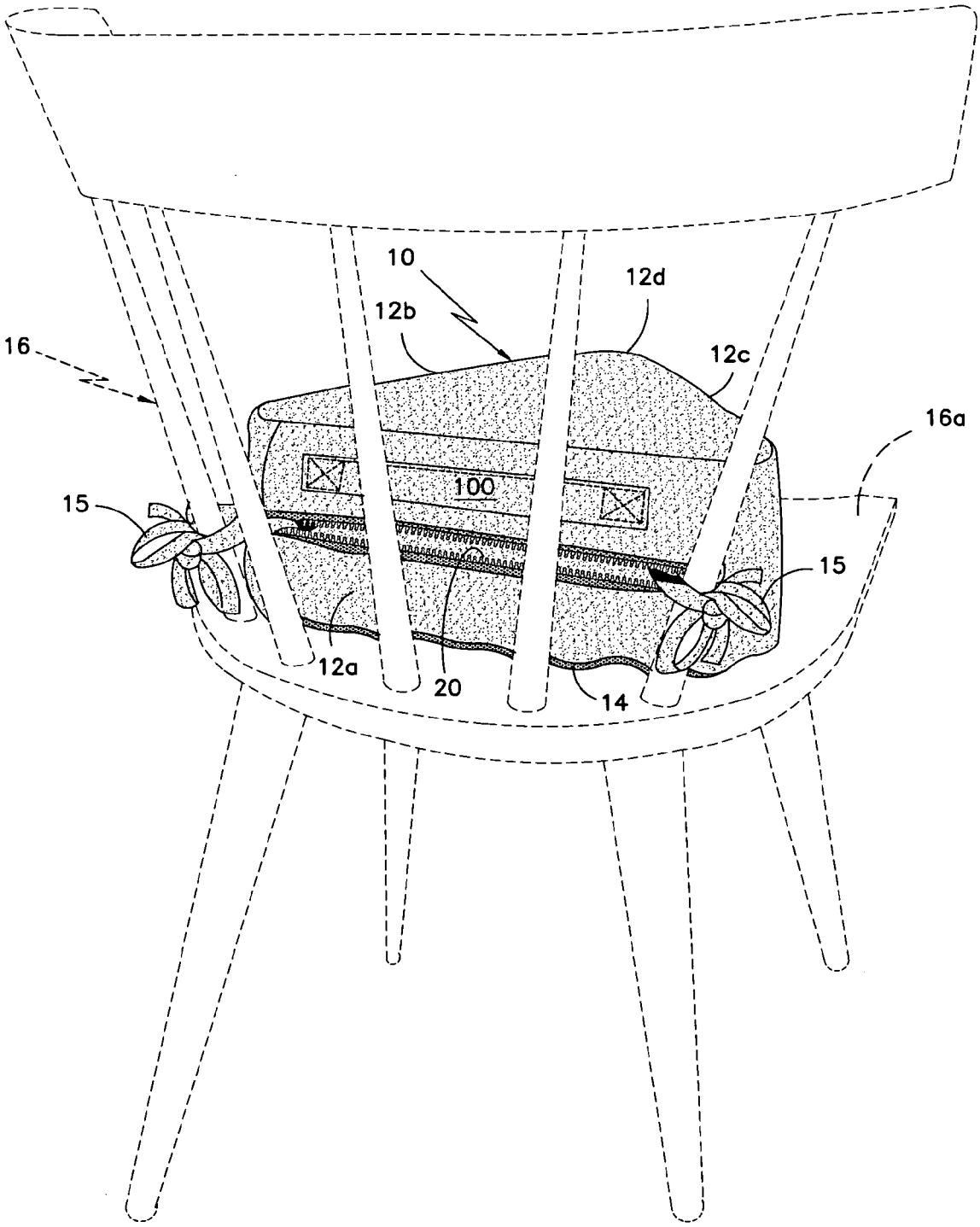
FIG. 4 shows the triangularly shaped booster seat in position on a conventional chair for use by a child, and also illustrates the deployment of the ties or flexible fasteners 15, 15. Although these flexible fasteners are shown to be simple cloth strings, in the preferred embodiment, it will be apparent that Velcro fasteners (not shown) can be provided on these flexible straps.
Figure 5:
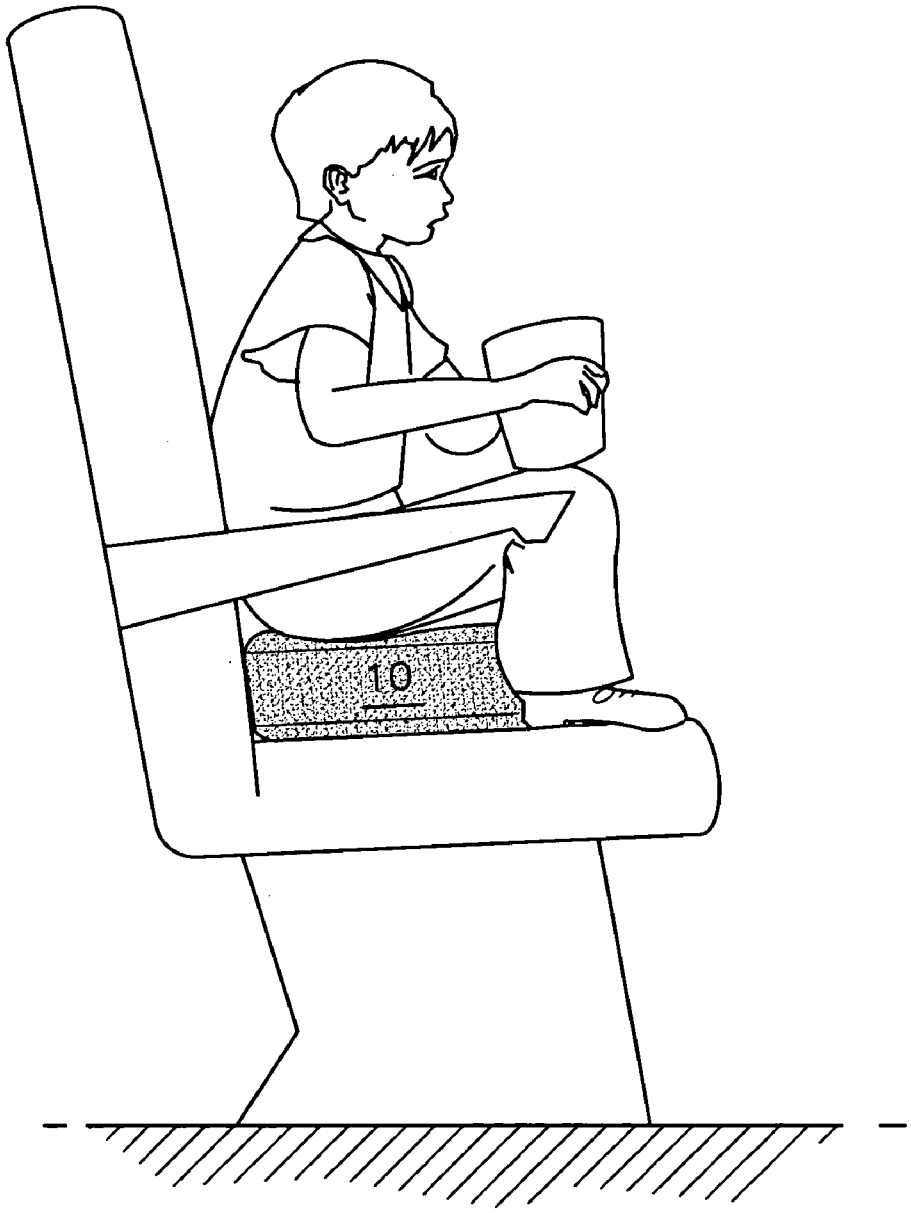
FIG. 5 illustrates a child in position atop the booster seat 10 of the present invention, the booster seat 10 being provided on an auditorium or theater type chair, which does not lend itself to use of the tie strings (15, 15, not shown).

The present disclosure shows for the first time an easily transportable booster seat 10 for a 12-month to 4 or 5 year old child. The cushion is light enough for the child to carry in one hand by the handle 100, as the weight is between 13 to 15 ounces (less than one pound). The triangular seat cushion allows the child to sit comfortably on the cushion. The triangular seat leaves room for the child's feet to rest upon the seat of the chair on which the cushion is provided, see for example FIG. 5. FIG. 4 shows the relative size of the seat/cushion of the present invention compared to a conventional kitchen chair 16. The sides 12*a*, 12*b* and 12*c* of the cushion are preferably of equal size and shape. Each side of the triangle is preferably on the order of one foot in length and even on a relatively small chair, the vertex 12*d* of the cushion opposite the base or pocket defining side 12*a* would not overlap the front edge of a conventional chair seat 16*a*. The vertex or pointed end 12*d* of the triangular cushion 12 would be located well within the outer edge of the conventional chair seat 16*a*.

Figure 6:
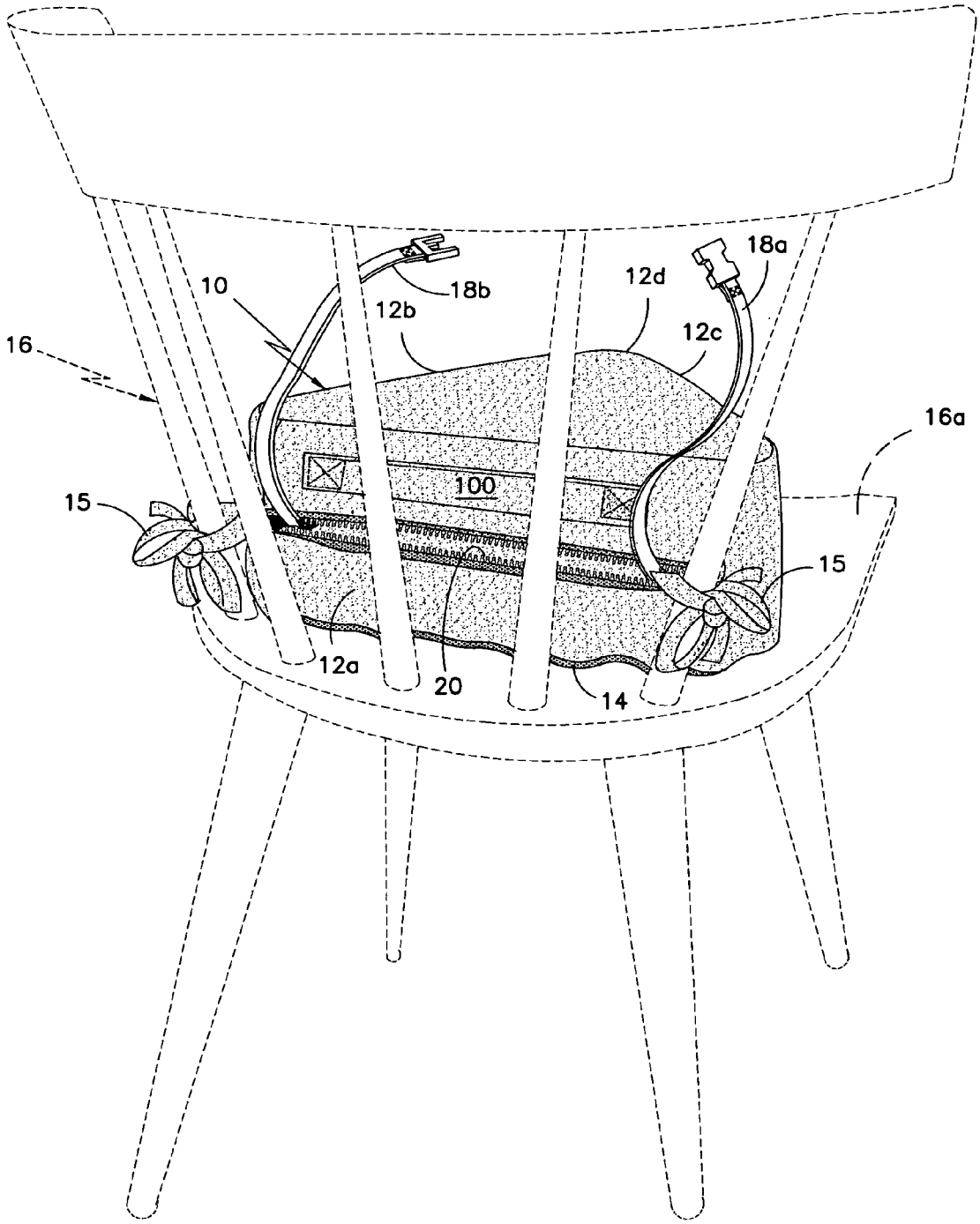
FIG. 6 illustrates the rear view of a kitchen chair as in FIG. 4 showing the seat belt 18*a*, 18*b* around a child's waist. A plastic buckle is provided on belt 18*a*, 18*b* in the embodiment shown.

FIG. 6 shows a safety belt 18*a*, 18*b* secured to the seat, and can be used in conjunction with the strap fasteners to secure the child and his booster seat to a chair.

In light of the above, it is therefore understood that within the scope of the appended claims, the invention may be practiced otherwise than as specifically described.

What is claimed is:

1. A child's booster seat comprising:

a generally triangular shaped polyfoam prism cushion having three generally equal length sides, and rounded corners of uniform convex contour, a cover containing said polyfoam cushion, said cover defining a pocket at one of said three sides, elongated fasteners secured to said one side of said cover for use in tying said seat to a chair, flexible straps with end portions secured to said cover at said one side, and having opposite end portions with mating fasteners to encircle a child's waist, said fasteners being stowable inside said pocket, and said one side of said cover further including a strap handle for carrying the seat and a closure for said pocket along side said strap handle, and said strap handle having opposite ends attached to said cover on said one side.

2. The seat according to claim 1 wherein said triangular polyfoam prism cushion has a height approximately one half the length of said sides.

3. The seat according to claim 2 wherein said polyfoam prism cushion is made of a light density material which has the ability to support the weight of a child without excessive compression of the cushion.

4. The seat according to claim 3 wherein the seat weighs less than one pound.

5. The seat according to claim 3 wherein the booster seat weighs less than one pound and all sides are of approximately 12 inches in length, and at least 5 inches in height.

* * * * *